US008704117B2

(12) United States Patent
Kim et al.

(10) Patent No.: US 8,704,117 B2
(45) Date of Patent: Apr. 22, 2014

(54) RF MEMS SWITCH USING CHANGE IN SHAPE OF FINE LIQUID METAL DROPLET

(75) Inventors: Joonwon Kim, Pohang-si (KR); Seong-Ho Son, Daejeon (KR); Soon Young Eom, Daejeon (KR); Usung Park, Pohang-si (KR); Seungbum Baek, Pohang-si (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 61 days.

(21) Appl. No.: 13/509,363

(22) PCT Filed: Nov. 10, 2010

(86) PCT No.: PCT/KR2010/007928

§ 371 (c)(1),
(2), (4) Date: May 11, 2012

(87) PCT Pub. No.: WO2011/059235

PCT Pub. Date: May 19, 2011

(65) Prior Publication Data

US 2012/0222944 A1 Sep. 6, 2012

(30) Foreign Application Priority Data

Nov. 12, 2009 (KR) ..... 10-2009-0109304

(51) Int. Cl.
*H01H 57/00* (2006.01)

(52) U.S. Cl.
USPC ..... 200/181

(58) Field of Classification Search
USPC ..... 200/181, 214–216, 219, 182, 187–193, 200/197, 199, 221–222, 226–229, 235–236, 200/239, 61.47
See application file for complete search history.

(56) References Cited

U.S. PATENT DOCUMENTS 6,323,447 B1 11/2001 Kondoh et al.
6,515,404 B1 2/2003 Wong (Continued)

FOREIGN PATENT DOCUMENTS

JP 4721645 A 10/1972
JP 48-83352 11/1973

(Continued)

OTHER PUBLICATIONS

Chung-Hao Chen and Dimitrios Peroulis, Electrostatic Liquid-Metal Capacitive Shunt MEMS Switch, 4 pages, Birck Nanotechnology Center, West Lafayette, The United States of America.

(Continued)

*Primary Examiner* — Edwin A. Leon
(74) *Attorney, Agent, or Firm* — William Park & Associates Patent Ltd.

(57) ABSTRACT

An RF MEMS switch using a fine liquid metal droplet is provided. The RF MEMS switch using a fine liquid metal droplet includes: a first layer member having a signal transmission line; a second layer member disposed on the first layer member, and having a chamber formed corresponding to the signal transmission line so as to induce a change in the shape of the fine liquid metal droplet and a through hole formed at one side of the chamber so as to bring the fine liquid metal droplet, whose shape is to be changed in the chamber, into contact or non-contact with the signal transmission line; an operating member disposed on the second layer member, and provided at an open side of the chamber so as to provide deformability to the fine liquid metal droplet through the open side of the chamber; and a third layer member for defining the position of the operating member, and coupled to the first layer member and the second layer member.

14 Claims, 8 Drawing Sheets

(56) References Cited

U.S. PATENT DOCUMENTS

| | | | | |
|---|---|---|---|---|
| 6,756,551 | B2 * | 6/2004 | Wong | 200/214 |
| 6,822,175 | B2 | 11/2004 | Kondoh et al. | |
| 6,870,111 | B2 * | 3/2005 | Wong | 200/182 |
| 6,879,088 | B2 | 4/2005 | Wong et al. | |
| 6,891,116 | B2 | 5/2005 | Dove et al. | |
| 7,189,934 | B2 | 3/2007 | Youngner | |
| 7,271,688 | B1 * | 9/2007 | Beerling et al. | 335/47 |
| 7,548,144 | B2 | 6/2009 | Kim et al. | |
| 2004/0200703 | A1 * | 10/2004 | Wong | 200/182 |
| 2004/0200708 | A1 | 10/2004 | Wong et al. | |

FOREIGN PATENT DOCUMENTS

| | | | |
|---|---|---|---|
| JP | 60140615 | A | 7/1985 |
| JP | 62140618 | U | 9/1987 |
| JP | 9161640 | A | 6/1997 |
| JP | 2000195389 | A | 7/2000 |
| JP | 2001-185017 | A | 7/2001 |
| JP | 2003-115658 | | 4/2003 |
| JP | 2004006238 | A | 1/2004 |
| JP | 2004319481 | A | 11/2004 |
| KR | 1020030039103 | A | 5/2003 |
| KR | 1020050111794 | A | 11/2005 |
| KR | 1020060068914 | A | 6/2006 |
| KR | 1020060129351 | A | 12/2006 |
| KR | 1020080109142 | A | 12/2008 |
| KR | 100910049 | B1 | 7/2009 |

OTHER PUBLICATIONS

Gabriel M. Rebeiz and Jeremy B. Muldavin, RF MEMS Switches and Switch Circuits, Microwave Magazine, Dec. 2001, pp. 13, University of Michigan, Ann Arbor, The United States of America.

* cited by examiner

RF MEMS SWITCH USING CHANGE IN SHAPE OF FINE LIQUID METAL DROPLET

BACKGROUND OF THE INVENTION (a) Field of the Invention

The present invention relates to an RF switch. More particularly, the present invention relates to an RF MEMS switch using a change in the shape of a fine liquid metal droplet, which changes an on/off or connection state of an RF signal.

(b) Description of the Related Art

An RF MEMS switch is used to change an on/off or connection state of an RF signal. For example, there is an RF MEMS (radio frequency micro-electromechanical systems) switch fabricated by a fine processing technology.

Moreover, the RF MEMS switch using the fine processing technology causes contamination and wear due to limitations on mechanical driving and solid-to-solid contacts, and therefore produces fine particles. Because the RF MEMS switch using the fine processing technology forms a solid-to-solid contact the actual contact area is very small, thus limiting the power of transmitted signals.

Among various solutions to this problem, an RF MEMS switch using solid-to-liquid contact rather than solid-to-solid contact is being developed. For example, there is an RF MEM switch using a fine liquid metal droplet.

The RF MEMS switch using a fine liquid metal droplet can solve the problem of contamination and wear caused by solid-to-liquid contact, and can transmit a high signal power by forming a large actual contact area.

However, it is necessary for the RF MEMS switch using the fine liquid metal droplet to have a structure in which the fine liquid metal droplet is free to move because the RF MEMS switch is switched on and off using the movement of the fine liquid metal droplet. Thus, the RF MEMS switch has a structure that is susceptible to shock, and has a low driving speed because it moves the entire fine liquid metal droplet.

SUMMARY OF THE INVENTION

The present invention has been made in an effort to provide an RF MEMS switch using a fine liquid metal droplet, which operates quickly and is resistant to shock and movement.

An exemplary embodiment of the present invention provides an RF MEMS switch using a fine liquid metal droplet, including: a first layer member having a signal transmission line; a second layer member disposed on the first layer member, and having a chamber formed corresponding to the signal transmission line so as to induce a change in the shape of the fine liquid metal droplet and a through hole formed at one side of the chamber so as to bring the fine liquid metal droplet, whose shape is to be changed in the chamber, into contact or non-contact with the signal transmission line; an operating member disposed on the second layer member, and provided at an open side of the chamber so as to provide deformability to the fine liquid metal droplet through the open side of the chamber; and a third layer member for defining the position of the operating member, and coupled to the first layer member and the second layer member.

The signal transmission line may be either a DC contact type for transmitting an RF signal when in contact with the fine liquid metal droplet or a capacitance type for transmitting an RF signal when not in contact with the fine liquid metal droplet.

The chamber may be defined as a space that becomes gradually narrower from top to bottom on an inclined surface connecting the top of the second layer member and the through hole.

The inclined surface may be reformed.

The operating member may be formed of a fluid membrane provided between the second layer member and the third layer member so as to apply pressure to the fine liquid metal droplet stored in the chamber.

The third layer member may include an air-tight terminal mounted corresponding to the chamber so as to apply pneumatic pressure supplied from a pump to the fluid membrane.

The chamber, the fine liquid metal droplet, and the operating member may be disposed in up and down directions on the same center line.

The chamber may include a first space formed in an upper part of the second layer member, and a second space connecting the first space and the through hole and formed smaller than the first space in a lower part of the second layer member.

The first space may be defined into an inner wall formed vertically with respect to the top surface of the second layer member and a bottom orthogonal to the inner wall and defining the second space.

The second space may be wide at the bottom, and may become gradually narrower towards the through hole.

The first space and the second space may be reformed.

The operation member may include a high voltage electrode and a ground electrode to be grounded that are disposed facing each other on the chamber so as to apply or not apply static electricity to the fine liquid metal droplet stored in the chamber.

The ground electrode may include a first pattern formed at the center of a disc and a second pattern cut from the first pattern in a radial direction, and the high voltage electrode may include a central portion disposed on the first pattern and an extraction portion to be extracted from the central portion along the second pattern.

The RF MEMS switch using the fine liquid metal droplet according to an exemplary embodiment of the present invention may further include an insulating layer provided between the operating member and the second layer member, and sealing the open side of the chamber.

DETAILED DESCRIPTION OF THE EMBODIMENTS

Figure 1:
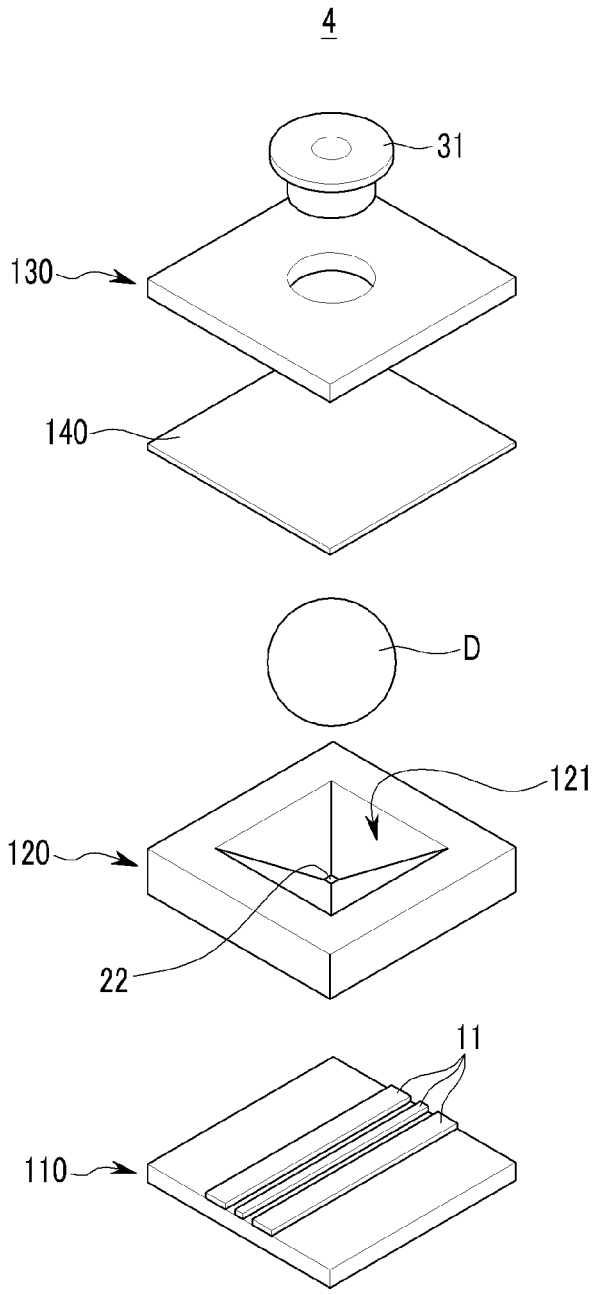
FIG. 1 is an exploded perspective view of an RF MEMS switch using a change in the shape of a fine liquid metal droplet according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

FIG. 1 is an exploded perspective view of an RF MEMS switch using a change in the shape of a fine liquid metal droplet according to a first exemplary embodiment of the present invention. Referring to FIG. 1, a radio frequency micro-electromechanical system switch 4 (hereinafter referred to as "RF MEMS switch" for convenience of description) according to the first exemplary embodiment of the present invention includes a first layer member 110, a second layer member 120, an operating member 140, and a third layer member 130.

The RF MEMS switch 4 has the advantage of having solid-to-liquid contact because it basically uses a fine liquid metal droplet (referred to as "droplet" for convenience of description). Also, the RF MEMS switch 4 is switched on and off using a change in the shape of a fine liquid metal droplet at a given location, so it has a relatively stable structure compared to the prior art when installed in equipment. This enables the RF MEMS switch 4 to be resistant to shock or movement and makes the operation fast.

Referring again to FIG. 1, the RF MEMS switch 4 is configured to control the on/off and connection of a signal transmitted along a signal transmission line 11 formed on the first layer member 10 by using a droplet D. The signal transmission line 11 includes a DC contact type (see FIG. 1) to be connected to transmit an RF signal when in contact with the droplet D and a capacitance type (not shown) to be separated to transmit an RF signal when not in contact with the droplet D.

The first layer member 110 forms a lower part of the RF MEMS switch 4, and is provided with a signal transmission line 11 on its top surface. In one example, the first layer member 110 can be formed of a glass substrate, and the signal transmission line 11 can be formed by patterning Cr/Ni on the first layer member 110.

The second layer member 120 is disposed on the first layer member 110, and has a chamber 121 formed corresponding to the signal transmission line 11 and a through hole 22 formed at the side of the signal transmission line 11 of the chamber 121. The chamber 121 is formed so as to receive the droplet D and induce a significant change in the shape of the droplet D. In one example, the second layer member 120 can be formed of a Si substrate, and the chamber 121 can be formed by bulk micromachining.

For instance, the chamber 121 is defined as a space that becomes gradually narrower from top to bottom on an inclined surface connecting the top of the second layer member 120 and the through hole 22. Accordingly, the droplet D received in the chamber 121 is deformed downward, so that the droplet D may be easily brought into contact or non-contact with the signal transmission line 11.

Moreover, the surface, i.e., inclined surface of the chamber 121 can be reformed to smooth the contact and separation of the droplet D with and from the signal transmission line 11. The surface-reformed chamber 121 allows the droplet D to smoothly move and undergo a change the shape, thereby making the contact and separation of the droplet D with and from the signal transmission line 11 easier.

Figure 2:
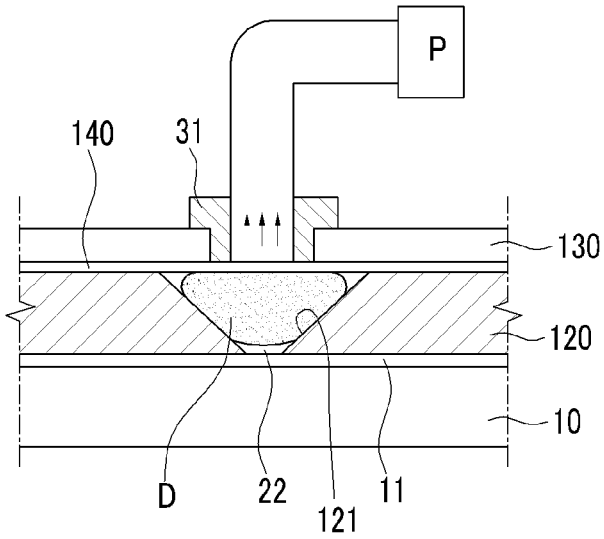
FIG. 2 is a cross-sectional view of the RF MEMS switch of FIG. 1 in which there is no change in the shape of the fine liquid metal droplet because no pneumatic pressure is applied to the fine liquid metal droplet or because a negative pressure is applied thereto.
Figure 3:
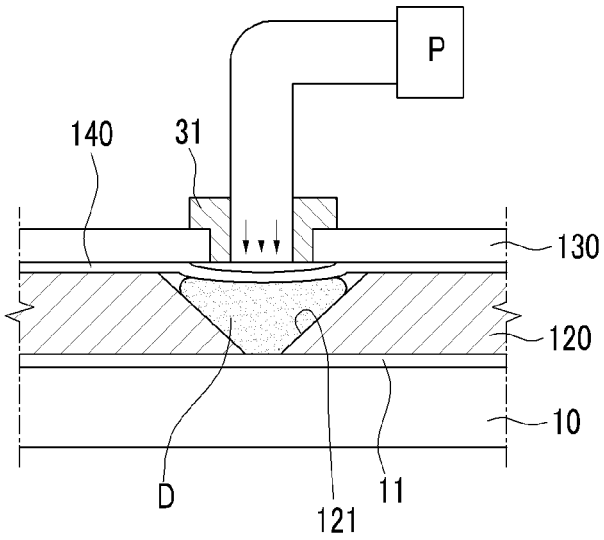
FIG. 3 is a cross-sectional view of the RF MEMS switch of FIG. 1 in which there is a change in the shape of the fine liquid metal droplet because a positive pressure is applied to the fine liquid metal droplet.

FIG. 2 is a cross-sectional view of the RF MEMS switch of FIG. 1 in which there is no change in the shape of the fine liquid metal droplet because no pneumatic pressure is applied to the fine liquid metal droplet or because a negative pressure is applied thereto. FIG. 3 is a cross-sectional view of the RF MEMS switch of FIG. 1 in which there is a change in the shape of the fine liquid metal droplet because a positive pressure is applied to the fine liquid metal droplet.

The operating member 140 is formed of a fluid membrane disposed on the second layer member 120 and provided at an open side of the chamber 121, and provides deformability to the droplet D through the open side of the chamber 121.

The operating member 140, i.e., the fluid membrane, is provided between the second layer member 20 and the third layer member 30 so as to apply pressure to the droplet D stored in the chamber 21. The third layer member 30 includes an air-tight terminal 31 mounted corresponding to the chamber 21 so as to apply pneumatic pressure supplied from a pump P to the operating member 140. The air-tight terminal 31 forms an air-tight structure around the operating member 140 and the third layer member 30 when pneumatic pressure is applied from the pump P to the operating member 140. At this time, the chamber 21 also provides a space where the operating member 140 is deformed.

Referring to FIG. 2, no pneumatic pressure is applied from the pump P, or negative pressure is applied. Therefore, the droplet D receives the negative pressure and the force caused by the operating member 140, so it is kept separate without contacting the signal transmission line 11 formed on the first layer member 110, thereby keeping a signal in the on state.

Referring to FIG. 3, positive pressure is applied from the pump P. Therefore, the droplet D receives the pressure and the force caused by the operating member 140, so it is brought into contact with the signal transmission line 11 formed on the first layer member 10, thereby keeping a signal in the off state.

In the first exemplary embodiment, the on/off of signal transmission can be controlled in accordance with the initial state of the operating member 140, i.e., the fluid membrane, and the pneumatic pressure (+, −pressure) applied to the fluid membrane.

The droplet D is driven by pneumatic pressure in the first exemplary embodiment, whereas the droplet D is driven by static electricity in a second exemplary embodiment to be described below.

Figure 4:
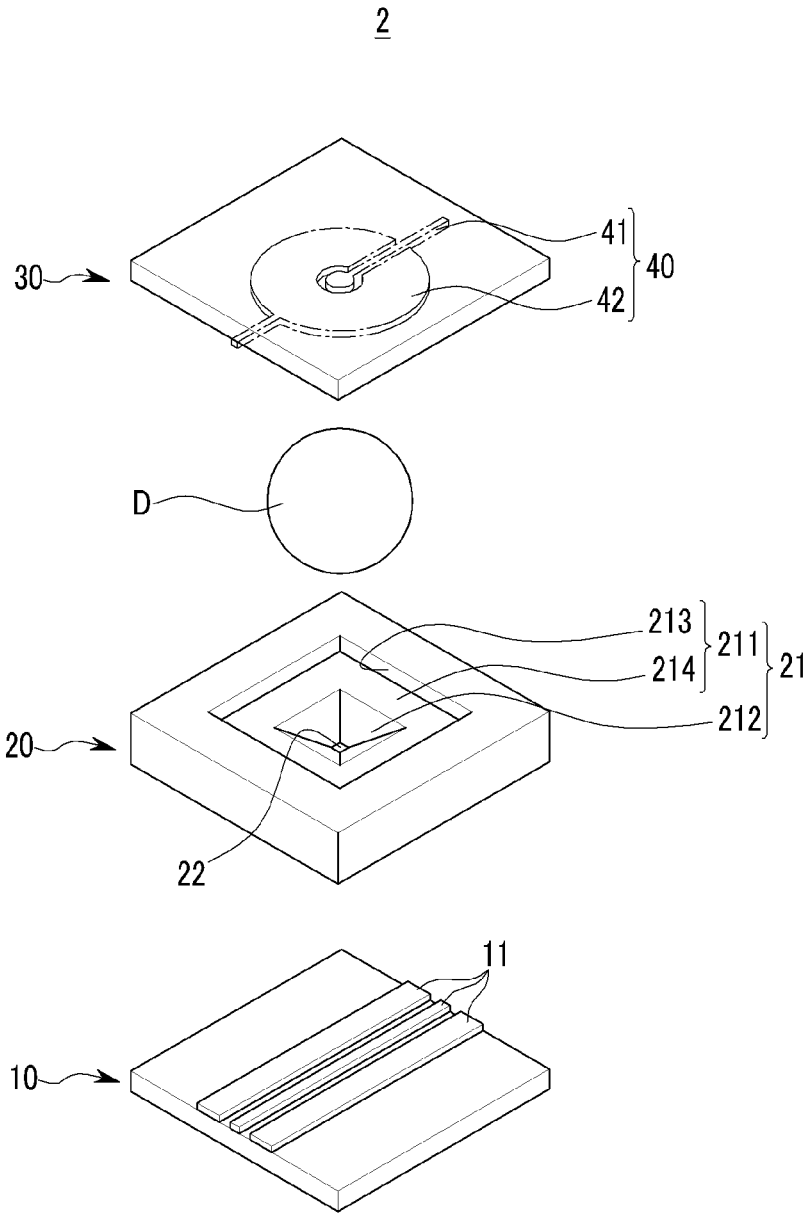
FIG. 4 is an exploded perspective view of an RF MEMS switch using a change in the shape of a fine liquid metal droplet according to a second exemplary embodiment of the present invention.

FIG. 4 is an exploded perspective view of an RF MEMS switch using a change in the shape of a fine liquid metal droplet according to a second exemplary embodiment of the present invention. Referring to FIG. 4, the RF MEMS switch 2 of the second exemplary embodiment includes a first layer member 10, a second layer member 20, an operating member 40, and a third layer member 30. In the second exemplary embodiment, descriptions of portions similar to or the same as those of the first exemplary embodiment are omitted and portions that are different from those of the first exemplary embodiment will be described.

In the second layer member 20, a chamber 21 has a two-stage structure, for example, the chamber 21 includes a first space 211 formed in an upper part of the second layer member 20 and a second space 212 formed in a lower part of the second layer member 20. The second space 212 connects the first space 211 and a through hole 22, and is smaller than the first space 211. Accordingly, the droplet D received in the first space 211 is deformed from the first space 211 to the second space 212. Herein, even a slight change in the shape in the larger first space 211 causes a significant change in the shape, so that the droplet D may be easily brought into contact or non-contact with the signal transmission line 11.

More specifically, the first space 211 is includes an inner wall 213 formed vertically with respect to the top surface of the second layer member 20 and a bottom 214 orthogonal to the inner wall 213. The second space 212 is wide at the bottom 214, and becomes gradually narrower towards the through hole 22.

Moreover, the surfaces, i.e., of the inner wall 213, the bottom 214, and the through hole 22 in the first and second spaces 211 and 212, can be reformed to smooth the contact and separation of the droplet D with and from the signal transmission line 11. The surface-reformed first space 211 allows the droplet D to smoothly move and undergo a change in the shape on the inner wall 213 and the bottom 214, and the surface-reformed second space 212 smoothes the up and down movement of the droplet D upon a change in the shape of the droplet D, thereby making the contact and separation of the droplet D with and from the signal transmission line 11 easier.

The operating member 40 is disposed on the second layer membrane 20 and provided at an open side of the chamber 21, and provides deformability to the droplet D through an open side of the chamber 21.

As an example, the operating member 40 can be composed of a high voltage electrode 41 that applies/does not apply static electricity to the droplet D stored in the chamber 21, and a ground electrode 42. In one example, the operating member 40, i.e., the high voltage electrode 41 and the ground electrode 42, may be formed by depositing and patterning Cr/Ni on the third layer member 30.

The high voltage electrode 41 and the ground electrode 42 are disposed facing each other on the chamber 21 and cause a change in the shape of the droplet D by applying a high voltage, thus bringing the droplet D into contact or non-contact with the signal transmission line 11.

Figure 5:
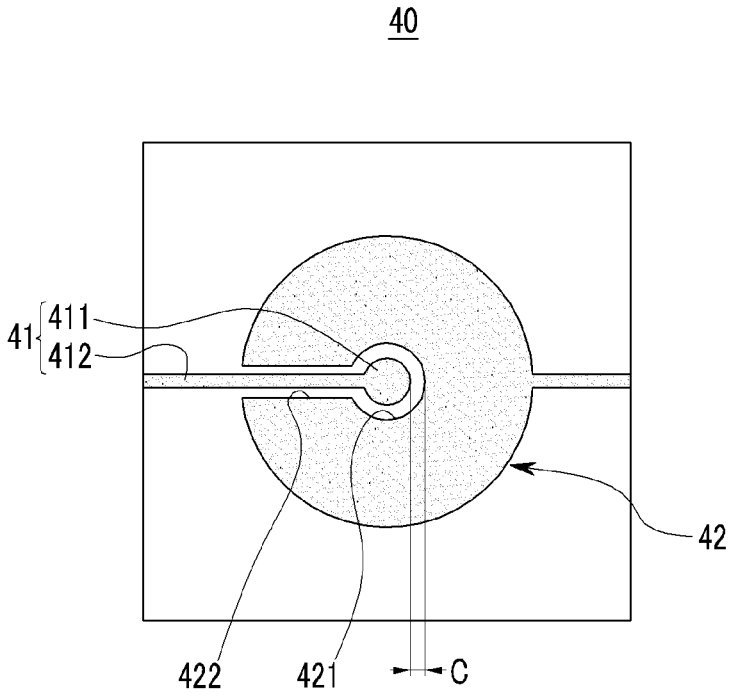
FIG. 5 is a top plan view of the RF-MEMS switch of FIG. 4 with no voltage applied to electrodes.
Figure 6:
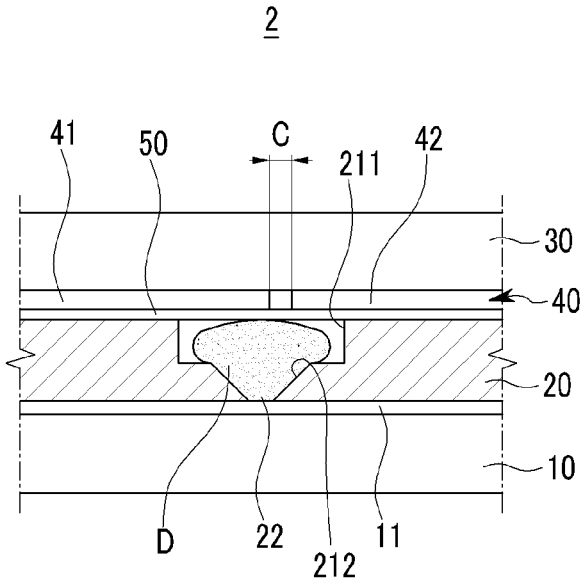
FIG. 6 is a cross-sectional view of a signal disconnection state in which there is no change in the shape of the fine liquid metal droplet in FIG. 5.
Figure 7:
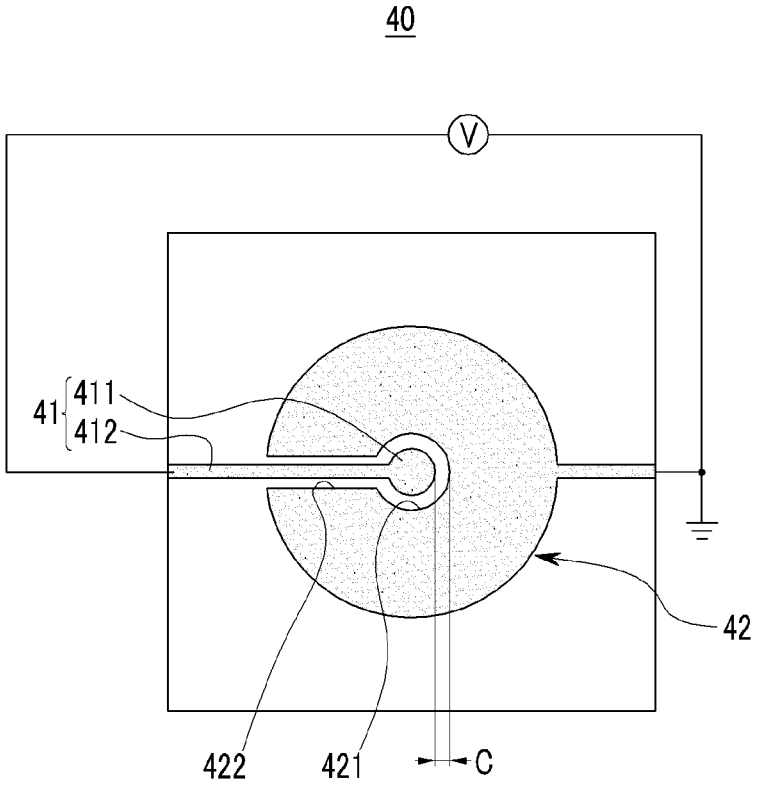
FIG. 7 is a cross-sectional view of the RF MEMS switch of FIG. 4 with a voltage applied to the electrodes.
Figure 8:
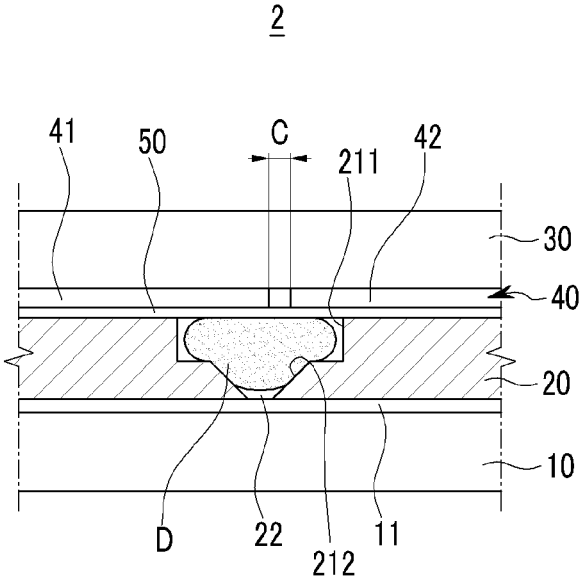
FIG. 8 is a cross-sectional view of a signal transmission state in which there is a change in the shape of the fine liquid metal droplet in FIG. 7.

FIG. 5 is a top plan view of the RF-MEMS switch of FIG. 4 with no voltage applied to electrodes, FIG. 6 is a cross-sectional view of a signal disconnection state in which there is no change in the shape of the fine liquid metal droplet in FIG. 5, FIG. 7 is a cross-sectional view of the RF MEMS switch of FIG. 4 with a voltage applied to the electrodes, and FIG. 8 is a cross-sectional view of a signal transmission state in which there is a change in the shape of the fine liquid metal droplet in FIG. 7.

Referring to FIGS. 5 to 8, the ground electrode 42 includes a first pattern 421 formed at the center of a disc and a second pattern 422 cut from the first pattern 421 in a radial direction. The high voltage electrode 41 includes a central portion 411 disposed on the first pattern 421 and an extraction portion 412 to be extracted from the central portion 411 along the second pattern 422. At this point, the high voltage electrode 41 and ground electrode 42 have a gap C formed therebetween, and are spaced apart from each other. That is, the first pattern 421 and second pattern 422 of the ground electrode 42 and the central portion 411 and extraction portion 412 of the high voltage electrode 41 are spaced apart from each other, respectively.

In the case that, as stated above, the operating member 40 is composed of the high voltage electrode 41 and the ground electrode 42, an insulating layer 50 is provided between the operating member 40 and the second layer member 20. The insulating layer 50 seals the open side of the chamber 21, and prevents the high voltage electrode 41 and the ground electrode 42 from directly contacting the droplet D.

The third layer member 30 defines the position of the operating member 40 on the second layer member 20, thereby forming an upper part of the RF MEMS switch 2. In one example, the third layer member 30 may be formed of glass. That is, the third layer member 30 has the operating member 30 provided on the surface facing the second layer member 20, and is coupled to the first and second layer members 10 and 20, thereby forming the RF MEMS switch 2.

The operation of the RF MEMS switch 2 will be described below by taking an example of the signal transmission line 11 of a capacitance type. Referring to FIGS. 5 and 6, the high voltage electrode 41 has no high voltage applied to it. That is, no static electric field is formed because there is no voltage difference between the high voltage electrode 41 and the ground electrode 42. Accordingly, the droplet D receives no force caused by static electricity, so it is brought into contact with the signal transmission line 11 formed on the first layer member 10. As a result, the signal transmission line 11 of the capacitor type disconnects a signal.

Referring to FIGS. 7 and 8, the high voltage electrode 41 has a high voltage applied to it. That is, a static electric field is formed by a voltage difference between the high voltage electrode 41 and the ground electrode 42. Therefore, the droplet D is deformed by the force caused by the static electricity, so the droplet D is not brought into contact with the signal transmission line 11 formed on the first layer member 10. Accordingly, the signal transmission line 11 of the capacitance type transmits a signal. The distance between the signal transmission line 11 and a spot where the droplet D is dropped can be adjusted by adjusting the voltage difference applied between the high voltage electrode 41 and the ground electrode 42.

As can be seen from the second exemplary embodiment, the signal transmission line 11, the chamber 21, the droplet D, and the operating member 40 are disposed in up and down directions on the same center line, and therefore cause a change in the shape of the droplet D, thereby bringing the droplet and the signal transmission line 11 into contact or non-contact with each other. Thus, the movement of the droplet can be made faster and a voltage for driving the droplet can be lowered.

As such, an exemplary embodiment of the present invention allows for fast operation of the fine liquid metal droplet and resistance to shock or movement as compared to the prior art because the fine liquid metal droplet is received in the chamber and brought into contact or non-contact with the signal transmission line by providing deformability to the operating member.

An exemplary embodiment of the present invention can realize driving for changing the shape of the fine liquid metal droplet in various configurations, and is free from the problems caused by electromagnetic waves if a fluid membrane and pneumatic pressure, rather than the high voltage electrode and the ground electrode, are to be used. Consequently, the present invention is applicable in more various fields.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An RF MEMS switch using a fine liquid metal droplet, comprising:

a first layer member having a signal transmission line;

a second layer member disposed on the first layer member, and having a chamber formed corresponding to the signal transmission line so as to induce a change in the shape of the fine liquid metal droplet and a through hole formed at one side of the chamber so as to bring the fine liquid metal droplet, whose shape is to be changed in the chamber, into contact or non-contact with the signal transmission line;

an operating member disposed on the second layer member, and provided at an open side of the chamber so as to provide deformability to the fine liquid metal droplet through the open side of the chamber; and a third layer member for defining the position of the operating member, and coupled to the first layer member and the second layer member.

2. The RF MEMS switch of claim 1, wherein the signal transmission line is either a DC contact type for transmitting an RF signal when in contact with the fine liquid metal droplet or a capacitance type for transmitting an RF signal when not in contact with the fine liquid metal droplet.

3. The RF MEMS switch of claim 1, wherein the chamber is defined as a space that becomes gradually narrower from top to bottom on an inclined surface connecting the top of the second layer member and the through hole.

4. The RF MEMS switch of claim 3, wherein the inclined surface is reformed.

5. The RF MEMS switch of claim 1, wherein the operating member is formed of a fluid membrane provided between the second layer member and the third layer member so as to apply pressure to the fine liquid metal droplet stored in the chamber.

6. The RF MEMS switch of claim 5, wherein the third layer member comprises an air-tight terminal mounted corresponding to the chamber so as to apply pneumatic pressure supplied from a pump to the fluid membrane.

7. The RF MEMS switch of claim 1, wherein the chamber, the fine liquid metal droplet, and the operating member are disposed in up and down directions on the same center line.

8. The RF MEMS switch of claim 1, wherein the chamber comprises:

a first space formed in an upper part of the second layer member; and a second space connecting the first space and the through hole and formed smaller than the first space in a lower part of the second layer member.

9. The RF MEMS switch of claim 8, wherein the first space is defined into:

an inner wall formed vertically with respect to the top surface of the second layer member; and a bottom orthogonal to the inner wall and defining the second space.

10. The RF MEMS switch of claim 9, wherein the second space is wide at the bottom, and becomes gradually narrower towards the through hole.

11. The RF MEMS switch of claim 8, wherein the first space and the second space are reformed.

12. The RF MEMS switch of claim 1, wherein the operation member comprises a high voltage electrode and a ground electrode to be grounded that are disposed facing each other on the chamber so as to apply or not apply static electricity to the fine liquid metal droplet stored in the chamber.

13. The RF MEMS switch of claim 12, wherein the ground electrode comprises a first pattern formed at the center of a disc and a second pattern cut from the first pattern in a radial direction, and the high voltage electrode comprises a central portion disposed on the first pattern and an extraction portion to be extracted from the central portion along the second pattern.

14. The RF MEMS switch of claim 12, further comprising an insulating layer provided between the operating member and the second layer member, and sealing the open side of the chamber.

* * * * *